United States Patent [19]

Cachero

[11] Patent Number: 4,899,887

[45] Date of Patent: Feb. 13, 1990

[54] TOTE BAG AND ATTACHED WEIGHTLIFTER'S BELT

[76] Inventor: Curtis J. G. Cachero, 1911 Halakau Pl., Honolulu, Hi. 96821

[21] Appl. No.: 345,027

[22] Filed: Apr. 28, 1989

[51] Int. Cl.[4] ..... A45C 3/00; A45C 13/00; A45C 13/30; A63B 71/12

[52] U.S. Cl. ..... 206/579; 206/315.1; 190/1; 190/102; 190/109

[58] Field of Search ..... 190/1, 25, 27, 101, 190/102, 109, 112; 150/106, 108; 224/224; 383/18, 19; 2/44, 600, 311; 128/78; 272/123; 206/315.1, 579

[56] References Cited

U.S. PATENT DOCUMENTS

| | | | |
|---|---|---|---|
| 1,958,003 | 5/1934 | Heyman | 190/102 |
| 4,301,898 | 11/1981 | Plough et al. | 206/315.1 X |
| 4,752,008 | 6/1988 | Pratt | 206/315.1 X |
| 4,773,515 | 9/1988 | Kotkins, Jr. | 190/112 X |
| 4,802,667 | 2/1989 | Altner | 128/78 X |
| 4,805,749 | 2/1989 | Gerch | 190/109 X |

FOREIGN PATENT DOCUMENTS

| | | | |
|---|---|---|---|
| 471609 | 2/1953 | Italy | 190/111 |
| 2070938 | 9/1981 | United Kingdom | 128/78 |

*Primary Examiner*—Sue A. Weaver

*Attorney, Agent, or Firm*—Zarley, McKee, Thomte, Voorhees & Sease

[57] ABSTRACT

The tote bag of the present invention comprises a container having an elongated tunnel extending through the middle of the container for receiving a weightlifter's belt. The weightlifter's belt extends through the tunnel and wraps around the top of the tote bag where it is secured in place for carrying.

7 Claims, 2 Drawing Sheets

TOTE BAG AND ATTACHED WEIGHTLIFTER'S BELT

BACKGROUND OF THE INVENTION

The present invention relates to a tote bag, and more particularly, a tote bag which can be used to carry a weightlifter's belt in addition to other materials used by a weightlifter.

Tote bags have been provided for various uses, but none of these tote bags are convenient for carrying the accessories required by weightlifters.

One accessory weightlifters use is a wide support belt which is several inches wide and which is thick and difficult to fold into a compact shape. It is therefore difficult to place these weightlifter's belts inside conventional carrying apparatus.

In addition to the need to carry a weightlifter's belt, the weightlifters also require a place to carry containers of liniments and other accessories needed by the weightlifter during competition.

Therefore, a primary object of the present invention is the provision of an improved tote bag which meets the needs of weightlifters.

A further object of the present invention is the provision of an improved tote bag which provides convenient means for carrying a weightlifter's belt.

A further object of the present invention is the provision of an improved tote bag which is capable of conveniently carrying a weightlifter's belt and is also capable of storing bottle containers of various materials needed by the weightlifter.

A further object of the present invention is the provision of a tote bag which not only carries the weightlifter's belt and other accessories, but includes a plurality of pockets and compartments for carrying various items of clothing or other accessories needed by weightlifter.

A further object of the present invention is the provision of a tote bag which is economical to manufacture, durable in use, and efficient in operation.

SUMMARY OF THE INVENTION

The present invention comprises a tote bag having a top wall, a bottom wall, opposite end walls, a front wall and a rear wall which combine to enclose a compartment therein. The bag has an openable door flap for permitting access to the compartment and includes carrying straps attached to its outer surface for carrying the device. A tube like tunnel passes from the front wall to the rear wall to provide a tunnel therethrough. The tunnel passes through the compartment, and is adapted to receive a belt which can be slipped through the tunnel and fastened together above the top wall of the tote bag. This forms the belt into a continuous loop passing through the tunnel and above the top wall.

Within the container are plurality of receptacles for receiving bottles of liniment or other accessories normally carried by weightlifters. Also, pockets are provided at opposite ends of the bag as well as in the front wall and the rear wall of the bag.

DETAILED DESCRIPTION OF THE PREFERRED EMBODIMENT

Figure 1:
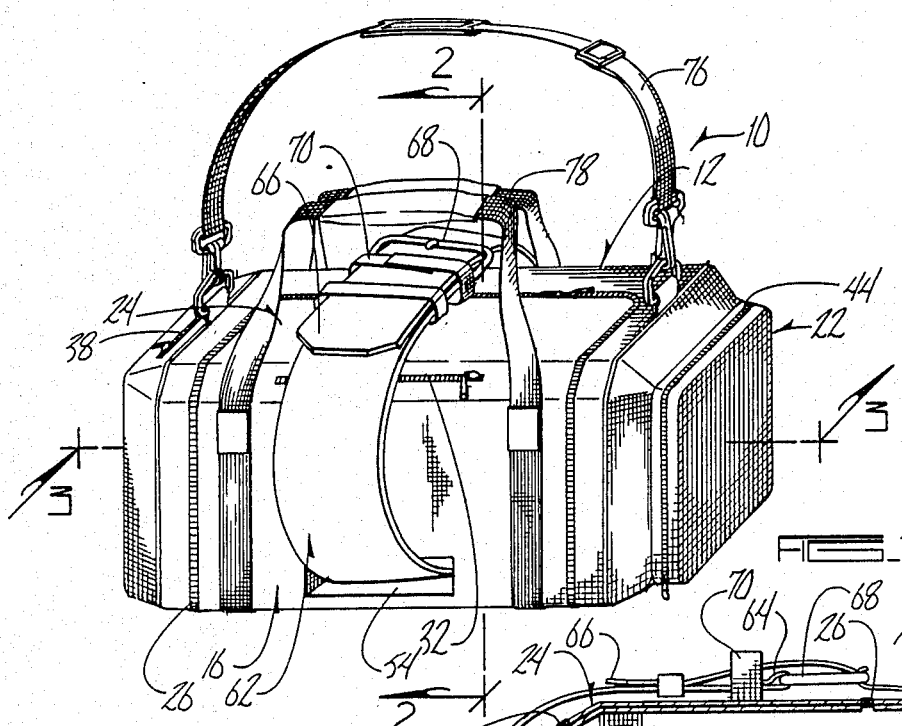
FIG. 1 is a perspective view of the tote bag of the present invention.

Referring to the drawings the numeral 10 generally designates the tote bag of the present invention. Tote bag 10 includes a top wall 12, a bottom wall 14, a front wall 16, a rear wall 18, and opposite end walls 20,22. A door flap 24 is joined at its lower edge to bottom wall 14 and extends upwardly across front wall 16 and partially across top wall 12. Door flap 24 is joined to front wall 16 and top wall 12 by means of a zipper 26 which extends around three sides of door flap 24. Door flap 24 also includes a pocket wall 28 (FIG. 2) which forms a pocket opening 30 inside door flap 24. A pocket zipper 32 provides an openable closure for pocket 30.

End wall 20 includes a pocket liner 34 (FIG. 3) which forms a pocket 36 having a zipper closure 38 at its upper end.

End wall 22 includes an enlarged pocket liner 40 which protrudes inwardly a substantial distance into the interior compartment 42 formed within tote bag 10. A zipper closure 44 permits access to the enlarged pocket 46 formed between pocket liner 40 and end wall 22.

Rear wall 18 also includes a pocket liner 48 spaced inwardly therefrom to form a pocket 50 having a zipper closure 52 at its upper end.

Adjacent the lower edge of front wall 16, and extending through door flap 24 is a rectangular opening 54, and registered with opening 54 in rear wall 18 is another rectangular opening 56. Extending between openings 54,56 is an elongated tunnel tube 58 which has a cross-sectional configuration corresponding to size and shape of openings 54,56 and which has its opposite ends secured around the margins of holes 54,56. Thus, tube 58 provides an elongated tunnel 60 extending between openings 54,56.

An elongated weightlifter's belt 62 includes first and second ends 64,66. End 64 is provided with a buckle 68 which is adapted to be attached to end 66 in conventional fashion.

Figure 2:
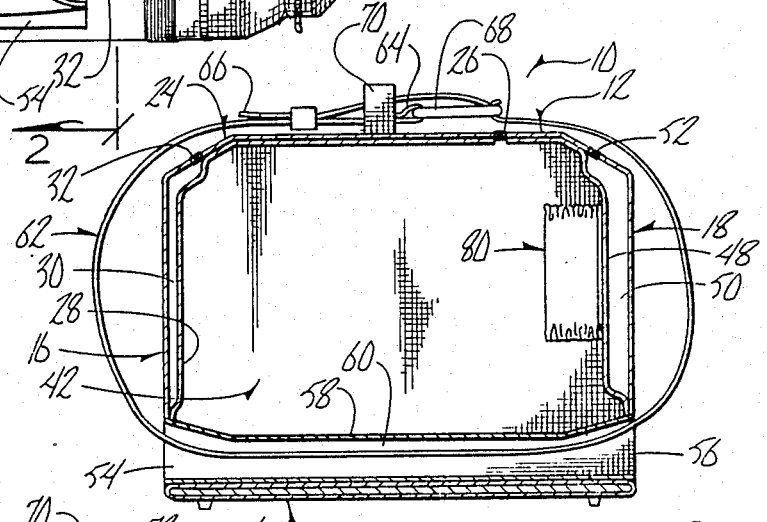
FIG. 2 is a sectional view taken along line 2—2 of FIG. 1.

Weightlifter belt 62 is formed into a loop with the lower most portion of the loop passing through tunnel 60 and with the opposite ends 64,66 being joined above top wall 12 as shown in FIG. 2. A belt retaining strap 70 is attached intermediate its opposite ends to door flap 24 and has its opposite ends 72,74 joined together by conventional securing means such as the fastener sold under the trademark "Velcro". Thus, the belt 62 is attached to tote bag 10 and is easily carried with the tote bag 10. A plurality of carrying straps 76,78 are provided on the tote bag for making it easy to carry.

Inside compartment 42 is a flexible sheet member 80 which is attached at spaced apart securing points 82,84,86,88 to rear wall 18 and which is adapted to receive and hold bottles or containers 90.

Figure 3:
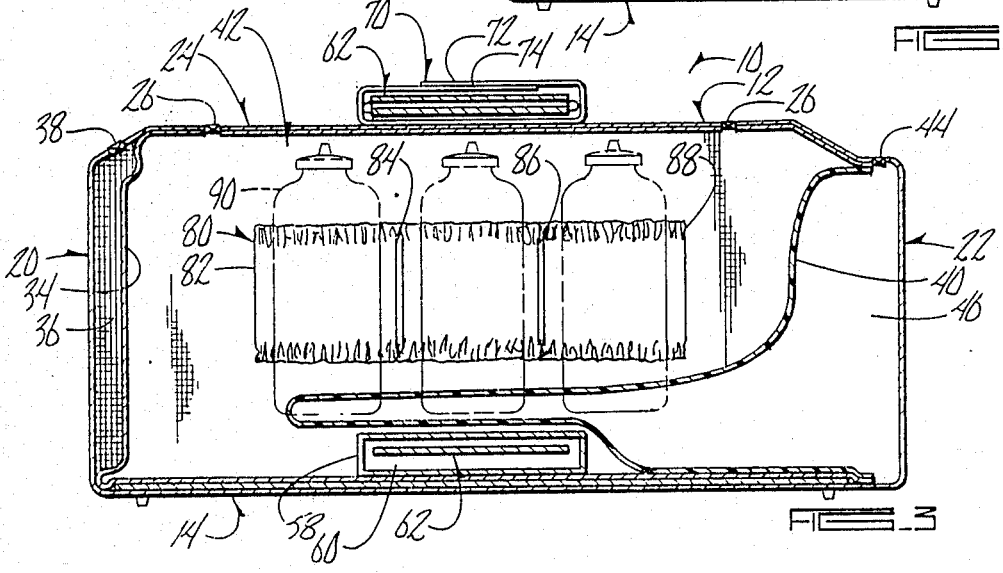
FIG. 3 is a sectional view taken along line 3—3 of FIG. 1.
Figure 4:
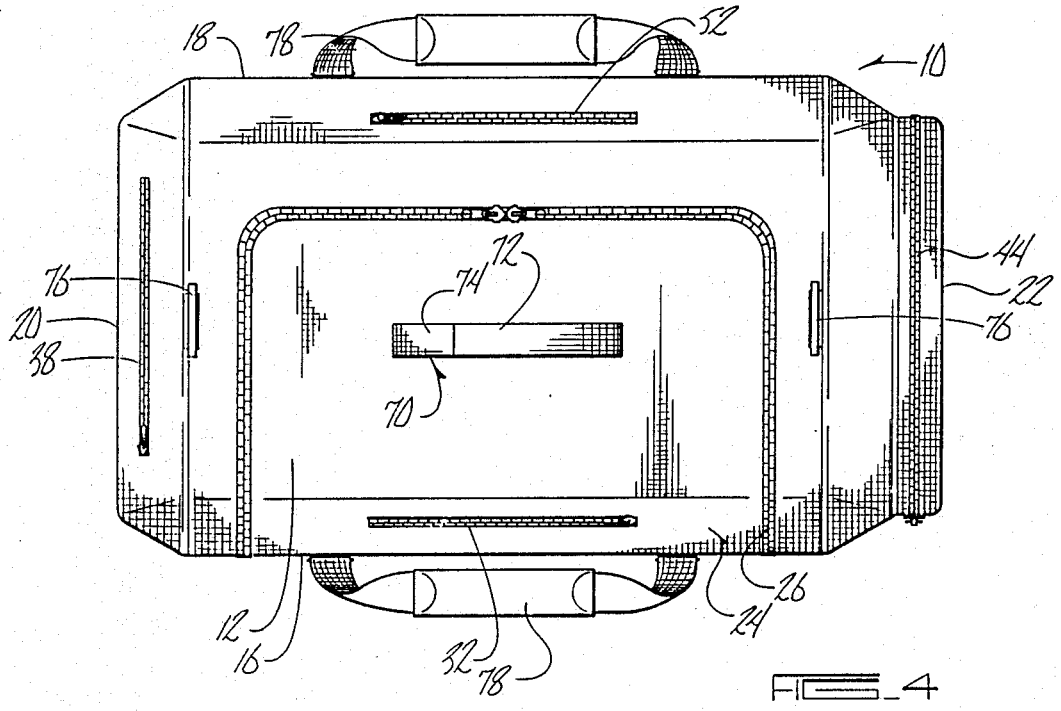
FIG. 4 is a top plan view of the tote bag shown in FIG. 1.

As can be seen in FIGS. 2 and 3, the tunnel 60 is completely isolated from the interior compartment 42 so that interior compartment 42 of the container is not exposed to the outside atmosphere. Belt 62 is often made of leather or semi-rigid material, and therefore the present invention permits the carrying of this belt without deforming it in order to store it in a compartment. Thus, it can be seen that the device accomplishes at least all of its stated objectives.

What is claimed is:

1. A tote bag comprising:

a container having a top wall, a bottom wall, opposite end walls, a front wall and a rear wall which combine to enclose a compartment therein;

an openable door flap in said container for permitting access to said compartment;

carrying strap means attached to said container;

said front and rear walls of said container each having a slot opening therein;

a tubular tunnel member extending between said slot openings of said front and rear walls and also extending through said compartment to form a tunnel therethrough;

a belt having first and second opposite ends and buckle means, said belt passing through said tunnel and said buckle means detachably securing said first and second opposite ends of said belt together so as to form said belt into a continuous loop passing through said tunnel and above said top wall.

2. A tote bag according to claim 1 and further comprising a belt strap attached to said top wall of said container, said belt strap having opposite ends extending around said belt, detachable securing means on said opposite ends of said belt strap detachably securing said opposite ends of said belt strap so that said belt strap surrounds said belt and holds said belt against movement relative to said container.

3. A tote bag according to claim 1 wherein said tunnel member comprises an elongated tubular member having first and second opposite ends and having a cross-section corresponding substantially to the shapes of said slot openings.

4. A tote bag according to claim 3 wherein said first and second opposite ends of said tunnel member are secured to said front and rear walls respectively in registered alignment over said slot openings whereby the interior of said tunnel is free from exposure to said compartment and said compartment is enclosed and free from exposure to the exterior of said container.

5. A tote bag according to claim 4 wherein said container includes bottle holding means located on the interior surface of one of said front and rear walls within said compartment, at least one bottle container being retentively held by said holding means.

6. A tote bag according to claim 5 wherein one of said end walls of said containers extends inwardly into said compartment to form a pouch having an open end presented toward the exterior of said container, selectively openable closure means extending over said open end of said pouch in covering relation thereto.

7. A tote bag according to claim 6 wherein a first pocket is formed on the exterior of the other of said end walls and a second pocket is formed on the exterior of at least one of said front and rear walls.

* * * * *